US005243501A

United States Patent [19]

Makita et al.

[11] Patent Number: 5,243,501

[45] Date of Patent: Sep. 7, 1993

[54] AUTOMOTIVE HEADLAMP

[75] Inventors: Hiroyuki Makita; Hirohiko Ohshio, both of Shizuoka, Japan

[73] Assignee: Koito Manufacturing Co., Ltd., Tokyo, Japan

[21] Appl. No.: 794,251

[22] Filed: Nov. 19, 1991

[30] Foreign Application Priority Data

Nov. 20, 1990 [JP] Japan ..... 2-312921
Sep. 13, 1991 [JP] Japan ..... 3-234785

[51] Int. Cl.[5] ..... F21M 3/05
[52] U.S. Cl. ..... 362/61; 362/293
[58] Field of Search ..... 362/61, 261, 293

[56] References Cited

U.S. PATENT DOCUMENTS 5,107,405 4/1992 Makita ..... 362/61
5,113,330 5/1992 Makita ..... 362/61
5,130,904 7/1992 Ohshio et al. ..... 362/293
5,132,881 7/1992 Wakimizu et al. ..... 362/61
5,180,218 1/1993 Ohshio et al. ..... 362/293

*Primary Examiner*—Richard R. Cole
*Attorney, Agent, or Firm*—Sughrue, Mion, Zinn, Macpeak & Seas

[57] ABSTRACT

An automotive headlamp employing a discharge lamp as its light source in which the emission of harmful ultraviolet ray is eliminated in the output light beam. The headlamp includes a lamp body, a reflector mounted in the lamp body, and a discharge bulb mounted in a bulb insertion hole in the rear portion of the reflector. The discharge bulb is composed of a lamp base, a pair of long and short lead supports projecting forward from the lamp base, the discharge lamp, a pair of lead wires extending in respective forward and rearward directions from front and rear end portions of the discharge lamp, and forward and rear metal supports welded to the long and short lead supports and to respective ones of the lead wires so as to support the discharge lamp at its opposite ends on the long and short lead supports. The forward end of the longer lead support terminates at a position substantially corresponding to a front end edge of the front portion of the discharge lamp. An ultraviolet-ray shielding globe encloses the discharge lamp so as to cut ultraviolet rays from light emitted by the discharge lamp. A front end portion of the ultraviolet-ray shielding globe is tapered so as not to interfere with light reflected from a circumferential edge portion of the reflector around the bulb insertion hole.

17 Claims, 7 Drawing Sheets

AUTOMOTIVE HEADLAMP

BACKGROUND OF THE INVENTION

The present invention relates to a automotive headlamp in which a discharge lamp is used as a light source.

As shown in FIG. 1, a conventional discharge lamp 1 has a rod-like structure in which a pair of pinch seal portions 1*b* and 1*c* are formed at front and rear portions, respectively, of a glass bulb 1*a*, and lead wires 2 (2*a*, 2*b*), which are connected to respective ones of the opposite electrodes in the closed glass bulb 1*a*, extend from the end portions of the pinch seal portions 1*b* and 1*c*, respectively. The lead wires 2 (2*a*, 2*b*) are fixedly welded to respective metal supports 5 (5*a*, 5*b*), which are in turn fixedly welded to respective ones of a pair of long and short lead supports 4 (4*a*, 4*b*) projecting forward from a lamp base 3 to thereby constitute a discharge lamp device in which the discharge lamp 1 is supported at its opposite ends.

Since a discharge lamp device has an excellent luminous efficiency and output light color characteristics, discharge lamps have been seriously considered for use as a bulb for an automotive headlamp. However, the light emission of a discharge lamp includes ultraviolet rays in a wavelength range which is harmful both to health and to various constituent parts of the headlamp. It is therefore necessary to eliminate ultraviolet rays in harmful wavelength ranges.

As shown in FIG. 1 of the drawings, to block such ultraviolet rays, conventionally an ultraviolet-ray shielding globe 6 enclosing the discharge lamp 1 has been fixed to the base so as to be integrated with the discharge lamp device.

In the case where such a discharge lamp is used as a bulb of a projection-type headlamp in which light reflected from a reflector 7 is projected and distributed by a projection lens 8 as shown in FIG. 1, the greater part of the light emitted by the discharge portion (the closed glass bulb) 1*a* of the discharge lamp (which is positioned at a first focus position of the reflector 7) is reflected from the reflector 7, as indicated by arrows in FIG. 4, and the reflected light is radiated and distributed forward by the projection lens 8 through a second focus on a light axis to thereby form a predetermined light distribution pattern.

However, there is a problem in the resulting light distribution in that a part of the light reflected from the reflector 7, and particularly the light $l_1$ reflected from a light reflection surface range 7*a* on the circumference of a bulb insertion hole, is rejected (i.e., reflected, absorbed, deflected, etc.) at a top end portion of the ultraviolet-ray shielding globe 6 (reference numeral 6*a* designates a portion at which the light $L_1$ is rejected), so that the intensity of illumination of a light-distribution pattern central portion is decreased. If the length of the discharge lamp 1 is reduced (i.e., if the respective lengths of the pinch seal portions 1*b* and 1*c* are reduced), the globe 6 can be shortened longitudinally, so that the problem of the light reflected from the reflector being rejected by the globe can be overcome. However, reducing the length of the discharge lamp 1 is difficult in view of problems of sealing the lead wires, preventing leakage of the gas sealed in the closed glass bulb, etc.

Accordingly, the inventors have conducted studies as to the shape of the ultraviolet-ray shielding globe to obtain an ultraviolet-ray shielding globe which does not interfere with the light reflected from the reflector.

SUMMARY OF THE INVENTION

The present invention has been attained in view of the above problems in the prior art, and an object thereof is to provide a automotive headlamp in which a discharge lamp device is used as the bulb, and the discharge lamp device has an ultraviolet-ray shielding globe shaped so as to prevent the rejection of light reflected from a reflector.

In order to attain the above and other objects, an automotive headlamp constructed according to the present invention is provided which comprises a reflector provided in a lamp body, a discharge bulb having a pair of lead wires extending in the forward/rearward direction of the lamp from respective front and rear end portions of a discharge lamp and which are fixedly welded to respective metal supports which are in turn fixedly welded to respective ones of a pair of long and short lead supports projecting forward from a lamp base so that the discharge lamp is supported at its opposite ends, and in which a discharge portion of the discharge lamp is positioned in the vicinity of a focus of the reflector, an ultraviolet-ray shielding globe enclosing the discharge lamp so as to block ultraviolet rays from light emitted from the discharge lamp, and a lens provided in front of the reflector so as to distribute the light reflected by the reflector in the forward direction of the lamp, wherein a forward end of the longer lead support is at a position corresponding substantially to a front end edge of the discharge lamp, and a front end portion of the ultraviolet-ray shielding globe is tapered so as not to interfere with light reflected from a light reflection surface range along a circumferential edge of a bulb insertion hole of the reflector.

A lamp holding portion for holding a pinch seal portion provided on a front end of the discharge lamp is formed on the metal support to which the front-end-side lead wire of the discharge lamp is fixedly welded, and a leg portion provided under the lamp holding portion is fixedly welded to the front end portion of the lead support, so that the lead-support front end portion extends only to a position substantially corresponding to the discharge lamp front end edge. Accordingly, the front end portion of the ultraviolet-ray shielding globe can be tapered so as not to interfere with the light reflected by the reflector. The light reflected by the reflector is not rejected by the ultraviolet-ray shielding globe, so that a suitable light-distribution pattern is obtained.

The discharge bulb may be supported at opposite ends of the globe by a pair of ceramic discs which are sealed to respective ends of the globe and discharge lamp.

DESCRIPTION OF THE PREFERRED EMBODIMENTS

Figure 1:
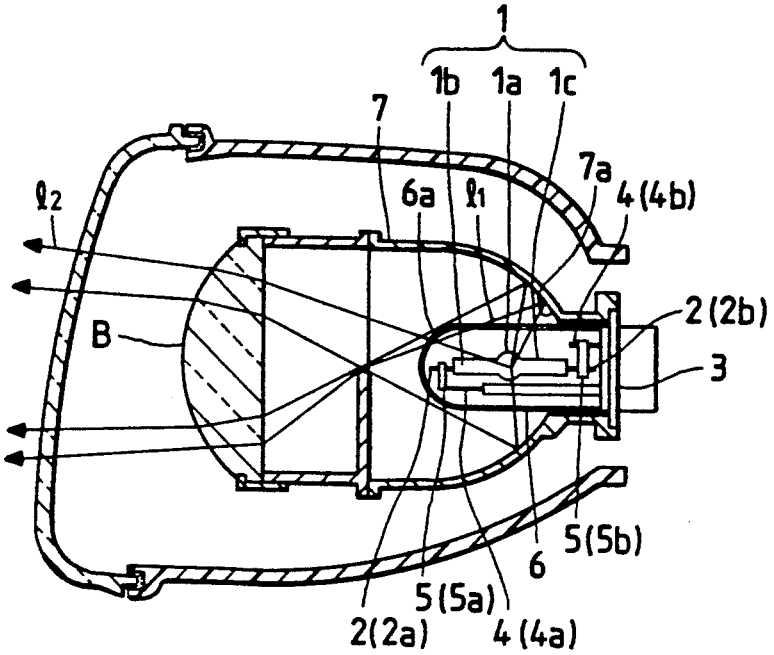
FIG. 1 PRIOR ART
FIG. 1 is a schematic view of a conventional automotive headlamp.

Referring to the drawings, preferred embodiments of the present invention will now be described.

Figure 3:
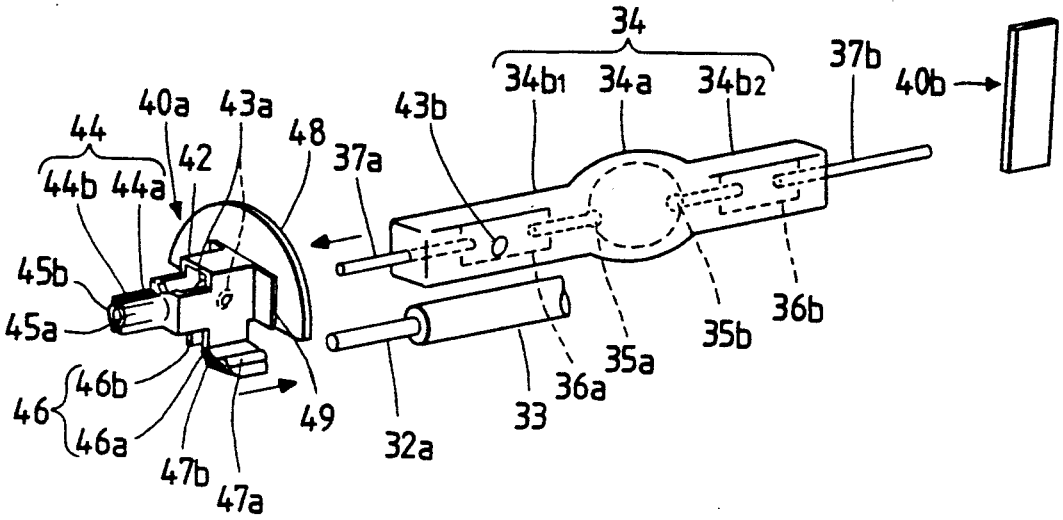
FIG. 3 is a partly broken perspective view of a discharge bulb.
Figure 2:
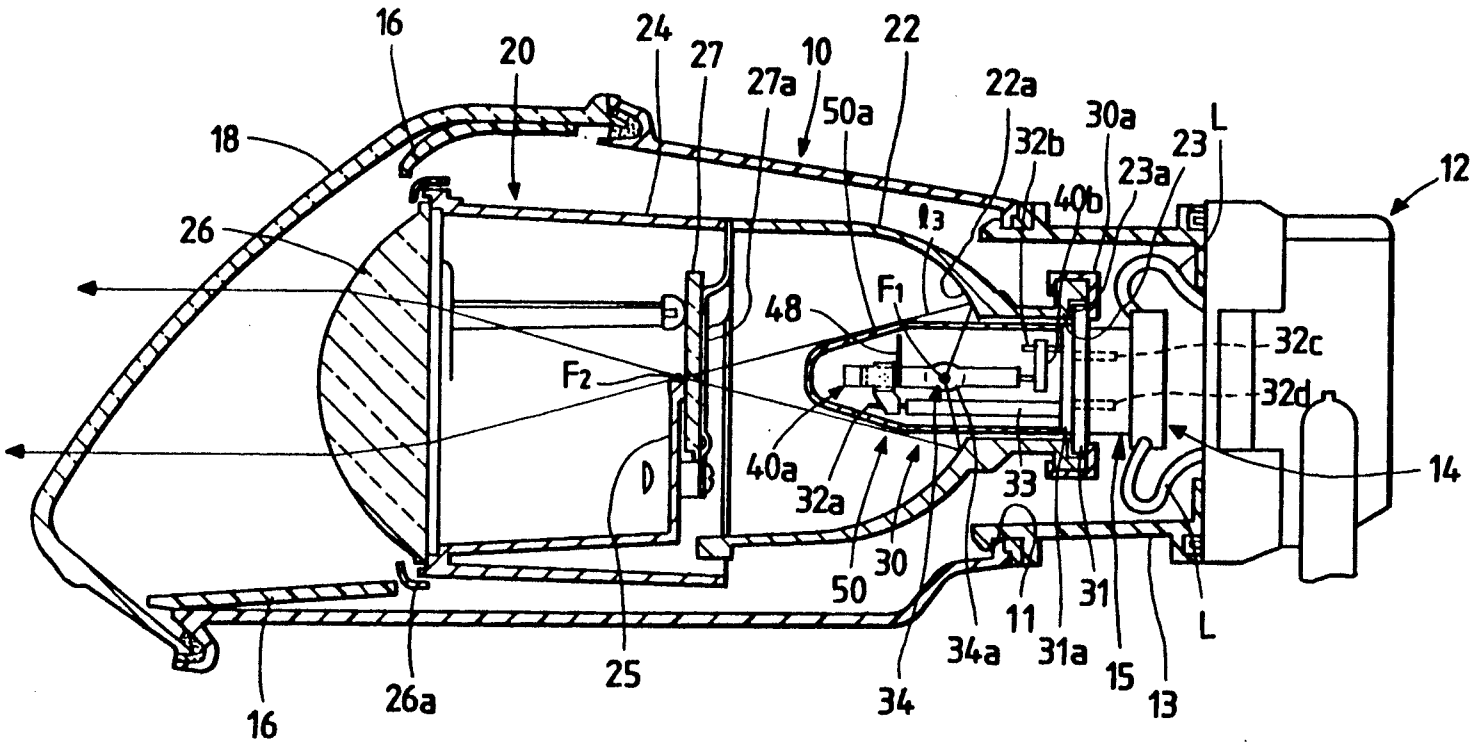
FIG. 2 is a vertical section of a automotive headlamp constructed in accordance with a first embodiment of the present invention.

FIGS. 2 and 3 show a first embodiment of the present invention. FIG. 2 is a vertical section of an automotive projection-type headlamp in which a discharge bulb is used as the light source, while FIG. 3 is an exploded perspective view showing a discharge-lamp supporting portion of the discharge bulb.

In the drawings, reference numeral 10 designates a vessel-like lamp body. A light projection unit 20 is tiltably supported by an aiming mechanism (not shown) in the lamp body 10.

The light projection unit 20 has a structure in which an oval reflector 22 made of a metal (e.g., aluminum), a discharge bulb 30 fittingly inserted into a bulb insertion hole 23 formed in the reflector at its rear top portion, and a lens holder 24 made of metal (e.g., aluminum) which has a projection lens 26 fixed to the front surface of the lens holder 24 and which is attached to the reflector 22 at its front opening portion, are integrated with each other. Reference numeral **30*a* designates a locking cap for fixing the discharge bulb 30 to the bulb insertion hole 23, and reference numeral 26*a* designates an annular lens fixing frame for mounting the projection lens 26 to the lens holder 24**.

The discharge bulb 30 has a structure wherein a discharge lamp 34 is supported by a pair of lead supports **32*a* and 32*b* projecting from the front surface of an insulating base 31. A discharge portion 34*a* of the discharge lamp 34 is provided at a first focus position F1 of the reflector 22. Further, a cylindrical ultraviolet-ray shielding globe 50 for enclosing the discharge lamp 34 is fixed to the front surface of the base 31 through a ceramic globe-holding plate 31*a*. Of the light emitted from the discharge portion 34*a*, the ultraviolet-ray shielding globe 50** blocks ultraviolet rays in harmful wavelength ranges.

In the vicinity of a second focus position F2 of the reflector 22, there are provided a shade 25 for forming a desired light-distribution pattern. The shade 25 is integrated with the lens holder 24. An ultraviolet-ray shielding filter 27 is fixed to the lens holder 24 by a metal plate spring member **27*a*. The light emitted from the discharge portion 34*a* of the discharge lamp 34 is reflected by the reflector 22, the reflected light is focused at the second focus F2 of the reflector 22, and the focused light is projected forward as parallel rays of light. The ultraviolet rays of light are cut twice when the light is transmitted through the ultraviolet-ray shielding globe 50 and the filter 27. The ultraviolet-ray shielding filter 27 has also the function of cutting ultraviolet rays in the light which emerges through the top end opening portion of the globe without passing through the globe 50**.

As shown in FIG. 3 in detail, the discharge lamp 34 has a structure wherein a circular-pipe-like quartz glass tube is pinched at its end portions, and transversely rectangular pinch seal portions **34*b*$_1$ and 34*b*$_2$ are integrated with opposite end portions of the closed glass globe 34*a*, the latter defining an oval discharge portion forming a discharge space. A starting rare gas, mercury and a metal halide are sealed in the glass globe 34*a*. Discharge electrodes 35*a* and 35*b* made of tungsten are provided in opposition to each other within the discharge space. The discharge electrodes 35*a* and 35*b* are connected to molybdenum foils 36*a* and 36*b* sealed in the pinch seal portions 34*b*$_1$ and 34*b*$_2$, respectively. Lead wires 37*a* and 37*b* connected to the molybdenum foils 36*a* and 36*b* extend from the end portions of the pinch seal portions 34*b*$_1$ and 34*b*$_2$, respectively. Metal supports 40*a* and 40*b* are welded to respective ones of a pair of long and short lead supports 32*a* and 32*b* which are insert-formed in the insulating base 31 and which project forward from the base, so that the discharge lamp 34 is supported at its opposite ends by the lead supports 32*a* and 32*b***.

The insulating lamp base 31 is a disc-like molding made of a synthetic resin material such as PPS or the like. Connector male terminals **32*c* and 32*d* integrally welded to the lead supports 32*a* and 32*b*, respectively, are projectingly formed on the base 31 at its rear side to thereby form a male connector 15**.

The metal support **40*b* is a plate body. An upper end portion of the metal support 40*b* is spot welded to the lead support 32*b*, while a lower end portion thereof is spot welded to the rear-end-side lead wire 37*b*. On the other hand, the metal support 40*a* has a structure wherein a lamp holding portion 42 for holding the pinch seal portion 34*b* on the front end side of the discharge lamp 34, a lead-wire fixing portion 44 to which the lead wire 37*a* extending from the front-end-side pinch seal portion 34*b* is fixedly welded, and a leg portion 46 to be fixedly welded to the front end portion of the lead support 32*a* are integrally formed. The metal support 40*a* is formed by bending and shaping a thin metal plate. The metal support 40*a* has an L-shaped side section. The vertical bar-like portion of the L shape forms the leg portion 46, while the transverse bar-like portion of the same forms the lamp holding portion 42 and the lead-wire fixing portion 44**.

A fan-shaped direct-ray shade 48 is welded to the lamp holding portion 42 so as to be integrated with the metal support **40*a*. The lamp holding portion 42, which is formed to fit with the pinch seal portion 34*b*$_1$, has a rectangular frame shape opening rearward. The pinch seal portion 34*b*$_1$ of the discharge lamp can be inserted from the rear opening portion into the lamp holding portion 42. A pair of convex portions 43*a* and 43*a*, engageable with concave portions 43*b* and 43*b* formed in the outer side surfaces of the pinch seal portion, are formed on the opposite inside walls of the lamp holding portion 42. The lead-wire fixing portion 44 is constituted by a pair of oppositely extending portions which extend forward from the lamp holding portion 42. Horizontal concave stripe portions 45*a* and 45*b* engageable with the lead wire 37*a* are formed in the opposite inside surfaces of the extended portions 44*a* and 44*b*, respectively. Further, the leg portion 46 is constituted by a pair of downward extending portions 46*a* and 46*b*, which are made to extend downward by bending from the lamp holding portion 42**.

Horizontal concave stripe portions 47*a* and 47*b*, engageable with the lead support 32*a*, are formed in the opposite inside surfaces of the extended portions 46*a* and 46*b*, respectively. The direct-ray shade 48, which is integrated through spot welding with an opening end of the lamp holding portion, has the function of shielding direct light at the discharge portion which otherwise be harmful in the formation of the low beam emitted from the lamp.

The discharge lamp 34 is fixedly integrated with the lead supports 32*a* and 32*b* in the following manner. First, the front-end-side lead wire 37*a* is inserted between the horizontal concave stripe portions 45*a* and 45*b* of the lead-wire fixing portion 44 to thereby pressingly insert the front-end-side pinch seal portion 34*b* into the lamp holding portion 42, so that the lamp-side concave portions 43*b* and the lamp-holding-portion-side convex portions 43*a* are engaged with each other to thereby perform positioning of the lamp holding portion 42 and the front-end-side pinch seal portion 34*b*$_1$. Accordingly, the metal support 40*a* can be easily assembled with the discharge lamp 34. Then, the front-end-side lead wire 37*a* is spot-welded to the lead-wire fixing portion 44, and the metal support 40*b* is spot-welded to the rear-end-side lead wire 37*b* so as to be integrated therewith. Succeedingly, the horizontal concave stripe portions 47*a* and 47*b* of the leg portion 46 of the assembly of the discharge lamp and the metal support are fitted to each other, the front end portion of the lead support 32*a* is inserted into the fitted horizontal concave stripe portions 47*a* and 47*b*, the discharge portion 34*a* of the discharge lamp to a predetermined position relative to the focus ring of the lamp base 31, and the metal supports 40*a* and 40*b* are spot-welded to the lead supports 32*a* and 32*b*, respectively.

Reference numeral 12 designates a driving circuit housing unit for housing a discharge-bulb driving circuit (not shown), which is integrally attached through a cylindrical extended portion 13 to an opening portion formed in the lamp body 10 at its rear top portion. A female connector 14 connected to lead wires L extending from the lighting circuit is connected to the male connector 15 integrally formed on the insulating base 31 at its rear side.

The ultraviolet-ray shielding globe 50, which is closed at its top end, is made of cylindrical transparent glass and is fixedly bonded to the ceramic plate 31*a* integrated with the lamp base 31 at its front surface. At least one of the inner and outer surfaces of the globe is coated with an ultraviolet-ray shielding film, such as ZnO or the like, capable of cutting ultraviolet rays in a predetermined wavelength range.

Thus, when the globe 50 is fixedly held by the base 31, the ultraviolet-ray shielding film enclosing the discharge lamp 34, and only visible light in which ultraviolet rays are cut is radiated to the outside of the globe 50.

A front end portion 50*a* of the ultraviolet-ray shielding globe 50 is tapered away so as not to interfere with light $l_3$ reflected on a reflecting surface 22*a* formed on the circumference of the bulb insertion hole 23 of the reflector 22. That is, the ultraviolet-ray shielding globe 50 is not in the light path of the light $l_3$ which is reflected by the reflector 22 to contribute to the output light distribution. Accordingly, unlike the conventional case (see FIG. 1), no part of the light which is reflected by the reflector to contribute to the desired output light distribution is shielded, as a result of which sufficient light is distributed in a "hot-zone" range to obtain a light-distribution pattern suitable in size and sufficient in intensity of illumination.

The shape of the tapered front end portion 50*a* of the globe can be realized by a combination of two measures. First, the lead support 32*a* is not permitted to extend forward beyond the front edge portion of the front-top-side pinch seal portion of the discharge lamp 34, while the L-shaped metal support 40*a* is not allowed to project forward beyond the front-top side lead wire 37*a*. Second, the direct-ray shade 48 is provided on the lamp holding portion 44 of the metal support 40*a*.

Reference numeral 16 designates a decorative laminated sheet provided on the circumference of the projection lens 26 of the light projection unit 20. A silver coating is applied to the surface of the decorative laminated sheet 16 to thereby improve the appearance of the lamp when not turned on. Further, reference numeral 18 designates a lens disposed over the front opening portion of the lamp body 10.

Figure 4:
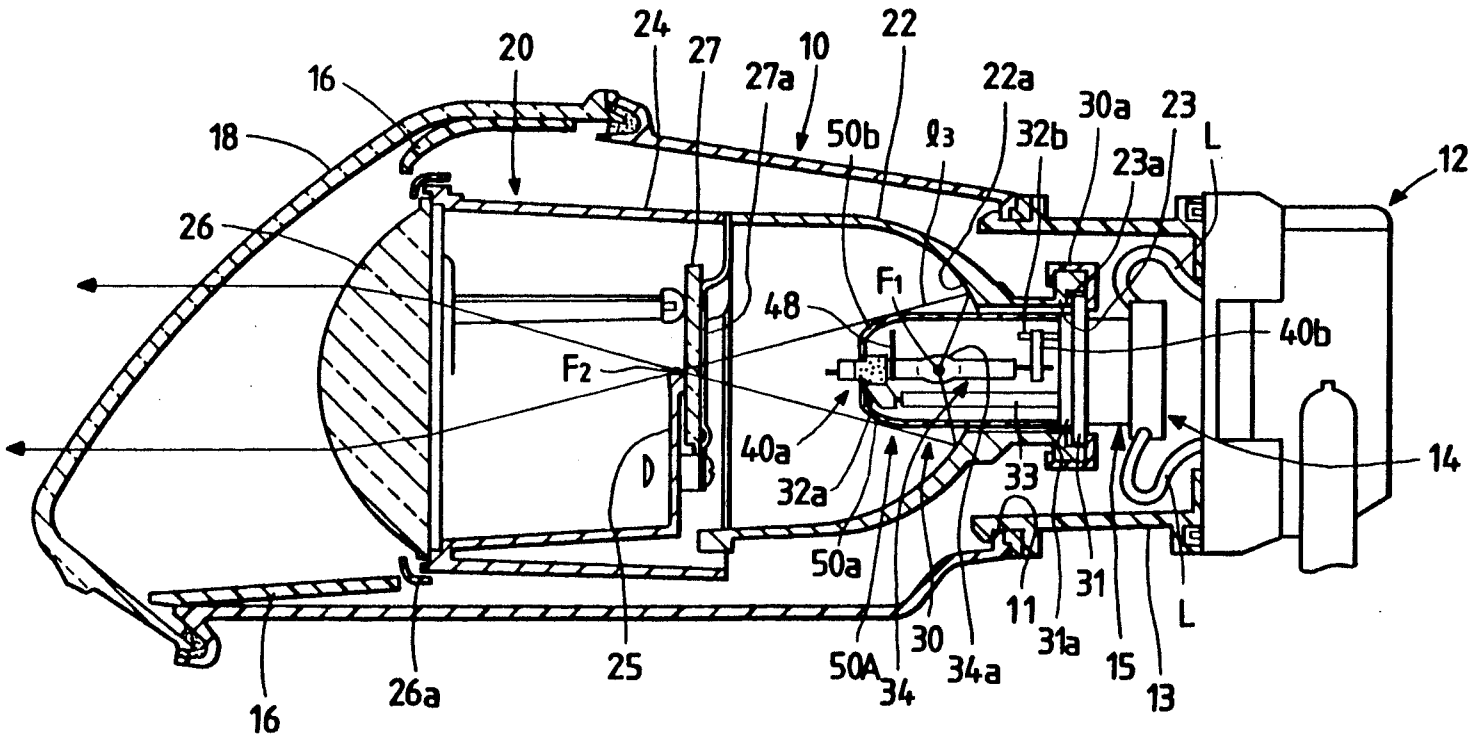
FIG. 4 is a vertical section of a automotive headlamp constructed according to a second embodiment of the present invention.

FIG. 4 is a vertical section showing a second embodiment of the automotive headlamp according to the present invention.

The second embodiment differs from the first embodiment in that, in order to prevent an ultraviolet shielding globe 50A from interfering with the light $l_3$ reflected by a reflector 22, a front end portion 50*a* of the ultraviolet shielding globe 50A has a curved surface the diameter of which is gradually reduced, and an opening portion 50*b* is formed in the top end of the ultraviolet shielding globe 50A. The circumferential edge portion of the opening portion 50*b* is positioned in front of a straight line connecting the discharge portion 34*a* and the circumferential edge of a direct-ray shade 48 so that, of the light emitted from the discharge portion 34*a* and directed forward, all light which is not shielded by the direct-ray shade 48 passes through the ultraviolet-ray shielding globe 50A.

A metal support 40*a* for supporting the front top end of the discharge lamp projects forward from the opening portion 50*b* of the globe, so that the horizontal length of the globe is made shorter than that of the first embodiment. Further, the globe 50A is opened at its front and rear ends, so that an ultraviolet-ray shielding film such as a ZnO film or the like can be easily formed.

Further, although the front end portion of the ultraviolet-ray shielding globe 50A is opened so that light emitted forward from the front opening portion contains ultraviolet rays in a harmful wavelength range, the ultraviolet rays in a harmful wavelength range are cut when the ultraviolet rays pass through an ultraviolet-ray shielding filter 27 provided in the vicinity of a second focus position F2 of the reflector 22. There is therefore no possibility that the lamp can cause a health hazard or cause damage to synthetic resin constituent parts of the lamp, etc.

The other portions are the same as those of the first embodiment and are correspondingly refererred. Therefore, a repeated description will be omitted.

Although each of the ultraviolet-ray shielding globes 50 and 50A and the ultraviolet-ray shielding filter 27 in the above embodiments has a structure in which the ultraviolet-ray shielding film is formed on the front surface, rear surface, or both front and rear surfaces of the opposite surfaces of glass, the globe and filter may be made of soda glass or hard glass having an ultraviolet-ray shielding function. Further, the ultraviolet shielding filter 27 may be not always provided.

Also, although the metal support 40*a* in each of the above embodiments is of a cassette type in which the discharge-lamp front end portion can be slidingly inserted, the present invention is not limited to such a cassette-type structure if the automotive headlamp has a structure in which there are formed a lamp holding portion for holding the front-end-side pinch seal portion and a lead-wire fixing portion for fixing the front-end-side lead wire.

Figure 5:
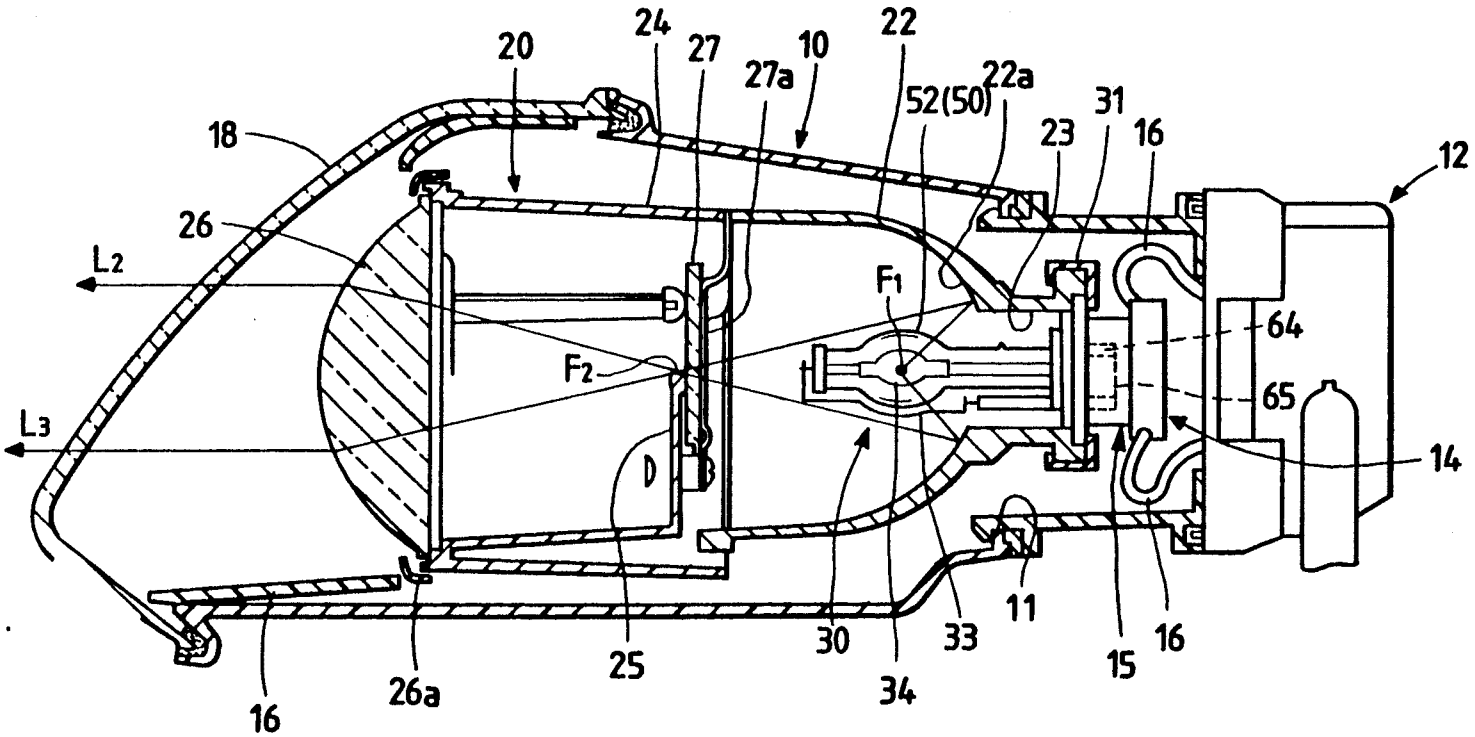
FIG. 5 is vertical section of an automotive headlamp constructed according to a third embodiment of the present invention.
Figure 6:
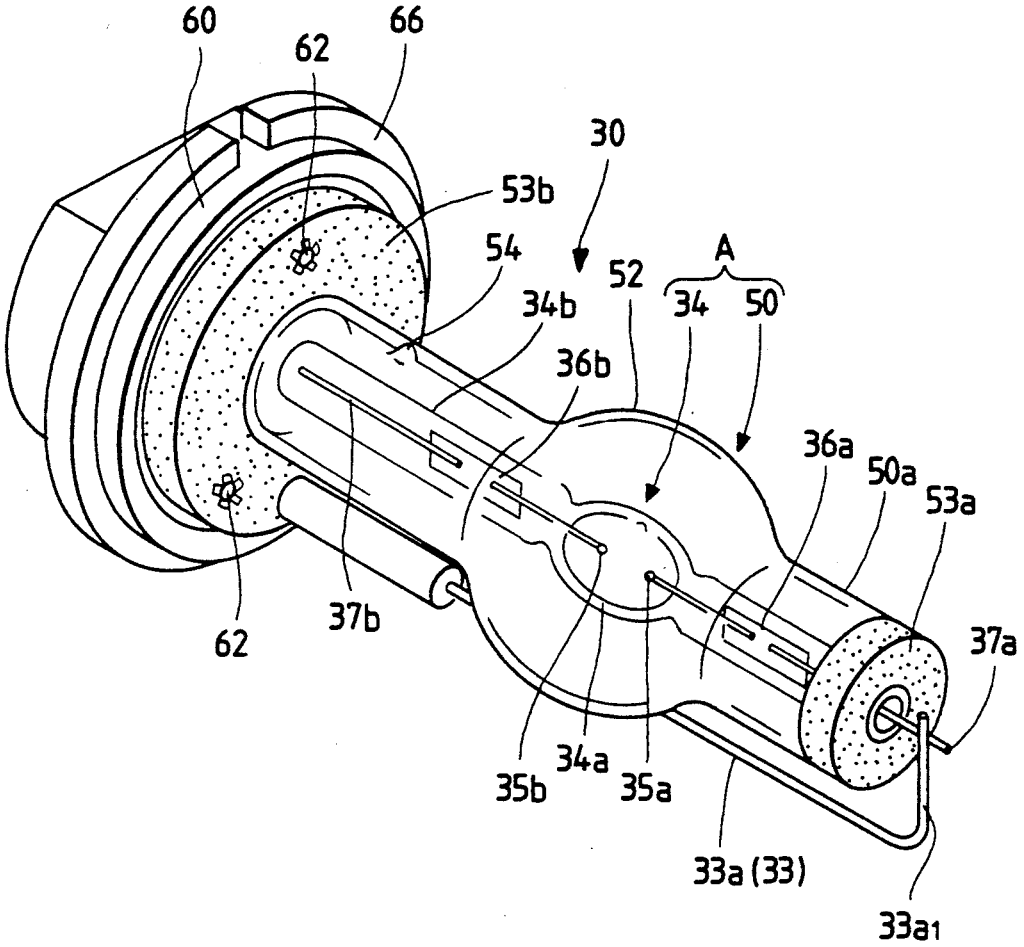
FIG. 6 is an enlarged perspective view of a discharge bulb employed in the third embodiment.
Figure 7:
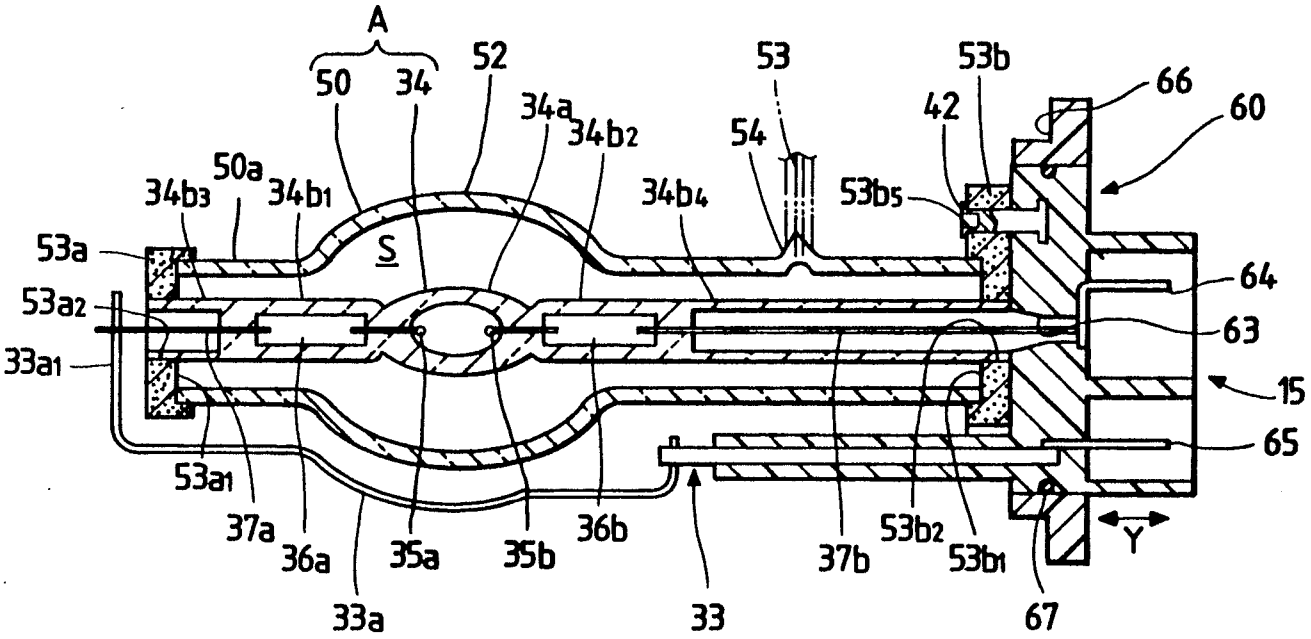
FIG. 7 is a vertical section of the discharge bulb of FIG. 6.

Referring to FIGS. 5 through 7 of the drawings, a third embodiment of the present invention will be described hereunder.

FIG. 5 is a vertical sectional view of an automotive projection-type headlamp in which a discharge bulb is used as a light source, FIG. 6 is a perspective view of the discharge bulb, and FIG. 7 is an exploded vertical section showing the discharge bulb.

In these drawings, components identified with the same reference numerals as applied in the previously described embodiments designate like elements, and a further detailed description of such elements will be omitted.

The discharge bulb 30 of the third embodiment employs a discharge lamp and globe assembly A in which a discharge lamp 34 and an ultraviolet-ray shielding globe 50 enclosing the discharge lamp 34 are integrated with each other through ceramic discs 53*a* and 53*b*. The discharge lamp is supported at its opposite ends by an insulating synthetic resin base 60 and a metal lead support 33. A discharge portion 34*a* of the discharge lamp 34 is disposed at the first focus position F1 of the reflector 22. In the vicinity of the second focus position F2 of the reflector 22, there are provided a shade 25 for forming a light-distribution pattern for a low headlamp beam, the shade being integrated with the lens holder 24, and an ultraviolet-ray shielding filter 27 fixedly held to the lens holder 24 by a metal plate spring member 27*a*.

Light emitted from the discharge portion 34*a* of the discharge lamp 34 is reflected by the reflector 22, the reflected light is focused at the second focus F2 of the reflector 22, and the focused light is projected forward as parallel rays of light. However, the ultraviolet rays of light are cut twice, namely, when the light is transmitted through the ultraviolet-ray shielding globe 50 and when it is transmitted through the filter 27.

The discharge bulb 30 is shown in detail in FIGS. 6 and 7. The discharge lamp 34 is made of a circular-pipe-like quartz glass tube, and has a structure in which transverse rectangular pinch seal portions 34$b_1$ and 34$b_2$ are integrally formed on the opposite end portions of the closed glass globe discharge portion 34*a*. Circular pipe-like portions 34$b_3$ and 34$b_4$ (which are not pinch seal portions) extend from the pinch seal portions 34$b_1$ and 34$b_2$ so as to form the opposite end portions of the discharge lamp 34. Discharge electrodes 35*a* and 35*b* made of tungsten are provided in opposition to each other in the closed glass bulb 34*a*. The discharge electrodes 35*a* and 35*b* are connected to molybdenum foils 36*a* and 36*b* sealed in the pinch seal portions 34$b_1$ and 34$b_2$, respectively. Lead wires 37*a* and 37*b* connected to the molybdenum foils 36*a* and 36*b* extend from the end portions of the pinch seal portions 34$b_1$ and 34$b_2$, respectively. The lead wires 37*a* and 37*b* extend to the outside through the circular pipe-like portions 34$b_3$ and 34$b_4$, respectively.

The ultraviolet-ray shielding globe 50 enclosing the discharge lamp 34 is a glass tube which is open at its opposite ends, and which is slightly shorter in length than the discharge lamp 34 but larger in outer diameter than the discharge lamp 34. The ultraviolet-ray shielding globe 50 is integrated with the discharge lamp 34 through ceramic discs 53*a* and 53*b* engaged with respective opposite opening portions of the globe 50 to thereby form a discharge lamp and globe assembly A.

The ceramic discs 53*a* and 53*b* have concave portions 53$a_1$ and 53$b_1$ engaging the globe 50 and discharge lamp engagement holes 53$a_2$ and 53$b_2$, respectively. The end portions of the discharge lamp 34 are inserted through the holes 53$a_2$ and 53$b_2$ of the ceramic discs 53*a* and 53*b*, respectively, while the end portions of the globe 50 are engaged with the engaging concave portions 53$a_1$ and 53$b_1$, respectively. An inorganic bonding agent is filled between the ceramic discs 53*a*, 53*b* and the globe 50 and the discharge lamp 34, so that the ceramic discs 53*a* and 53*b*, the globe 50, and the discharge lamp 34 are integrally fixed to each other, and the volume S between the globe and the lamp 34 is sealed from the exterior.

An area 52 of the globe 50 corresponding to the discharge portion 34*a*, which is the primary region from which heat is emitted from the discharge lamp 34, is expanded into an ellipsoidal shape having a diameter larger than that of the end opening portions of the globe so that the high-temperature portions of the discharge lamp 34 are separated from the globe 50. As a result of these measures, the surface temperature of the globe 50 is maintained relatively low.

Accordingly, although silicon may be spattered from the sealing agent filled in the portion engaging the lamp body 10 and the transparent cover 18, or from a synthetic resin silicon material in the lamp-chamber space, because of a temperature rise due to heat generation of the discharge lamp 34 when the discharge bulb is turned on, the generation of $SiO_2$ is suppressed. There is thus no possibility of $SiO_2$ being deposited on the discharge lamp 34 because the silicon cannot contact the discharge lamp 34, which has a high surface temperature, although it may contact the globe 50, which has a low surface temperature. Accordingly, there is no disadvantage of the discharge lamp 34 becoming clouded after being used for a time to thereby reduce the luminous efficiency.

The inside and/or the outside of the globe 50 are coated with an ultraviolet-ray shielding film such as ZnO or the like for cutting ultraviolet rays. The durability of the ultraviolet-ray shielding film is apt to become low at a high temperature. However, the vacuum state within the volume S is effective to suppress the reduction of the durability of the ultraviolet-ray film.

Reference numeral 54 designates a pinch seal portion provided on the globe 50. When the discharge lamp and globe assembly A is formed, such a vertical tube as indicated by reference numeral 53 in FIG. 7 projects from the pinch seal portion 54. A vacuum is pulled in the volume S through the vertical tube 53. Thereafter, the vertical tube 53 is pinched off.

In the discharge lamp and globe assembly A, the rear-end-side ceramic disc 53*b* is fixedly supported on the front surface of the insulating base 60 by three rivets 62. That is, in the front surface of the insulating base 60, there are provided the three rivets 62, each having a base portion fixed in the insulating base and projecting forward so that the rivets 62 penetrate through holes 53$b_3$ of the rear-end-side ceramic disc 53*b*. The top ends of the rivets are plastically transformed outward in the radial direction so that the circumferential edge portions of the respective holes are caulk-fixed by the rivets 62.

Further, the lead wire 37*b* extending from the circular pipe-like portion 34*b*$_4$ penetrates through a horizontal through hole 63 formed in the insulating base 60 and welded to a terminal 64 formed on the insulating base 60 through insertion molding. Further, the lead wire 37*a* extending from the circular pipe-like portion 34*b*$_3$, which is the front end portion of the discharge lamp, is spot-welded to a bent top-end portion 33*a*$_1$ of a lead wire 33*a*, which is a top-end-portion range of the lead support 33.

Reference numeral 65 designates a terminal integrated with the base end portion of the lead support 33. This terminal 65 forms a male connector 15 together with the terminal 64. A male connector 14 connected to output leads 16 from a lighting circuit housing unit 12 is connected to the male connector 15.

Reference numeral 66 designates a focus ring fixed to the circumferential edge portion of the insulating base 60. The focus ring 66 and the insulating base 60 constituting a reference abutting portion for positioning the discharge bulb 30 in the bulb insertion hole 23 of the reflector 22 have a structure in which a metal ring 67 is interposed between the opposite surfaces of the members 66 and 60 so that the members 66 and 60 are slidable relative to one another in the circumferential direction and in the axial direction (the Y direction indicated in FIG. 7). In the position where the closed glass bulb 34*a* of the discharge portion and the focus ring 66 are axially and circumferentially positioned, the metal ring 67 is heated through high-frequency inductive heating so that the opposite surfaces of the members 60 and 66 are integrally welded with each other.

A front end portion 50*a* of the ultraviolet-ray shielding globe 50 has an opening of a diameter smaller than that of the range 52 corresponding to the discharge portion of the discharge lamp 34 so as not to interfere with light $L_2$ and $L_3$ reflected from the reflecting surface 22*a* around the circumference of the bulb insertion hole 23 of the reflector 22. That is, the ultraviolet-ray shielding globe 50 is not on the light path of the light $L_2$ and $L_3$ reflected by the reflector 22. Accordingly, unlike the conventional case (FIG. 1), no part of the light which is reflected by the reflector to contribute to the output light distribution is rejected by the globe 50, so that it is possible to obtain a sufficient light distribution in the hot-zone range which is suitable in both in pattern and in sufficiency of the intensity of illumination.

The shape whereby the diameter of the globe front-end portion 50*a* is made smaller than that of the range 52 corresponding to the discharge portion 34 so that the rejection of the hot-zone forming light is prevented can be realized with a structure in which the discharge lamp 34 and the globe 50 are integrated with each other through the ceramic discs 53*a* and 53*b* into the discharge lamp and globe assembly A, and the front end portion of the assembly A is supported by the lead support projected from the insulating base 60. Although the lead support 33 is positioned in the path of light $L_3$ reflected from a hot-zone forming light reflecting surface 22*a*, no problem in light distribution arises because the lead support 33 is thin.

Reference numeral 16 designates a decorative laminated sheet provided on the circumference of the projection lens 26 of the light projection unit 20. A silver coating is applied to the surface of the decorative laminated sheet 16 to thereby improve the appearance of the headlamp when the headlamp is not turned on.

Figure 8:
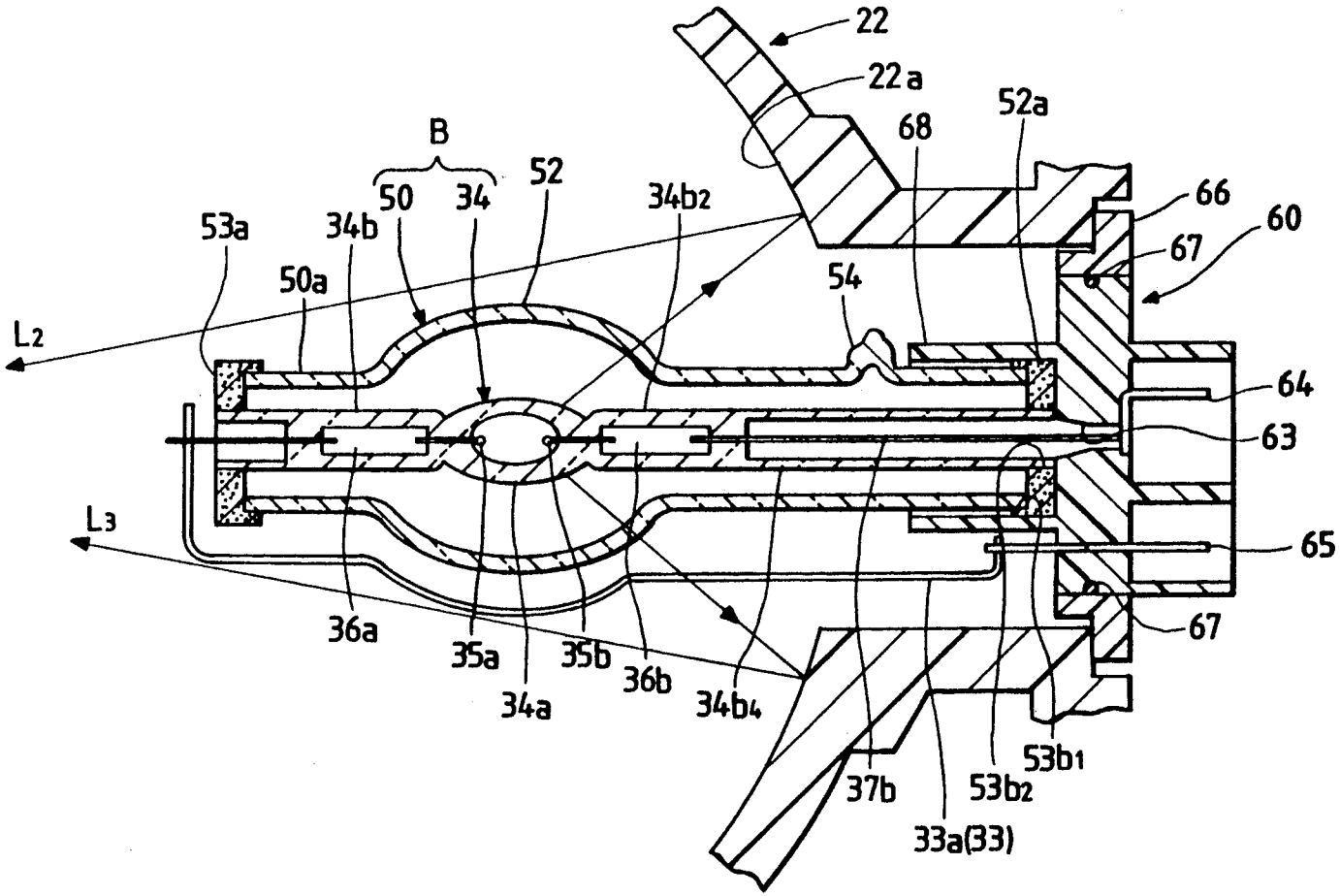
FIG. 8 is a main-part vertical sectional view of an automotive headlamp according to a fourth embodiment of the present invention.

FIG. 8 is a main part sectional view showing a fourth embodiment of an automotive headlamp according to the present invention.

The fourth embodiment differs from the previously described embodiment only in the structure of a part of the discharge bulb; other parts of the fourth embodiment are the same as in the third embodiment. Therefore, the same parts are correspondingly referenced, and a repeated description will be omitted.

That is, although the front and rear ceramic discs 53*a* and 53*b* differ in shape from each other in the third embodiment, the front and the respective shapes of the rear ceramic discs 53*a* and 53*a* in the fourth embodiment are the same. Thus, the fourth embodiment has the advantage that the number of different constituent parts is reduced.

Further, the fourth embodiment has a structure in which a rear end portion of a discharge lamp and globe assembly B, in which a discharge lamp 34 and a globe 50 are integrated with each other through the ceramic discs 53*a* and 53*a*, is engaged and fixedly bonded in a cylindrical portion 68 projectingly formed on a front surface of an insulating base 60. In comparison with the caulk-fixing arrangement employed in the third embodiment, therefore, the structure for fixing the discharge lamp and globe assembly B to the insulating base 60 is also simplified also in the fourth embodiment.

Further, a terminal 65 penetrates through the insulating base 60 and projects forward from the base, and a lead support 33 has a structure in which a lead wire 33*a* is spot-welded to the forward projected portion of the terminal 65. In comparison with the previously described embodiment, therefore, the structure of the lead support 33 is also simplified in the fourth embodiment.

Although a direct-ray shade is provided so as to cut harmful rays from the low beam in the above-described embodiments, the direct-ray shade is generally unnecessary in the case where the present invention is applied to a headlamp for forming a high beam.

Moreover, although the present invention has been described with reference to a projection-type headlamp by way of example, the present invention is not limited to headlamps of the projection type but can be applied to a parabolic-reflector-type headlamps.

As apparent from the above description, in the automotive headlamp according to the present invention, the front end portion of the ultraviolet-ray shielding globe enclosing the discharge lamp is tapered so as not to interfere with the light reflected by the reflector, so that the above-described problem of rejection of light is overcome. Thus, it is possible to obtain a light distribution having a suitable intensity of illumination. Further, of the light emitted from the discharge portion, ultraviolet rays in a harmful wavelength range are cut by the ultraviolet-ray shielding globe so that the lamp cannot cause a health hazard and cannot damage other components of the headlamp, namely, those made of a synthetic resin.

What is claimed is:

1. An automotive headlamp comprising:

a lamp body;

a reflector mounted in said lamp body;

a discharge bulb mounted in a bulb insertion hole in a rear portion of said reflector, said discharge bulb comprising a lamp base, lead support means projecting forward from said lamp base, a discharge lamp connected to said lead means, and an ultraviolet-ray shielding globe disposed around said discharge lamp for cutting ultra-violet rays from light emitted by said discharge lamp, a front end portion of said ultraviolet-ray shielding globe being dimensioned and shaped so as to not interfere with light reflected from a circumferential edge portion of said reflector around said bulb insertion hole; and a lens provided in front of said reflector so as to distribute light reflected by said reflector in a forward direction of said headlamp.

2. An automotive headlamp comprising:

a lamp body;

a reflector mounted in said lamp body;

a discharge bulb mounted in a bulb insertion hole in a rear portion of said reflector, said discharge bulb comprising a lamp base, a pair of long and short lead supports projecting forward from said lamp base, a discharge lamp, a pair of lead wires extending in respective forward and rearward directions from front and rear end portions of said discharge lamp, and forward and rear metal supports fixedly welded to said long and short lead supports, respectively, and to respective ones of said lead wires to support said discharge lamp at its opposite ends on said long and short lead supports, a discharge portion of said discharge lamp being positioned substantially at a focus of said reflector, a forward end of said longer lead support being at a position substantially corresponding to a front end edge of said front portion of said discharge lamp, and an ultraviolet-ray shielding globe enclosing said discharge lamp so as to cut ultraviolet rays from light emitted by said discharge lamp, a front end portion of said ultraviolet-ray shielding globe being tapered so as not to interfere with light reflected from a circumferential edge portion of said reflector around said bulb insertion hole; and a lens provided in front of said reflector so as to distribute light reflected by said reflector in a forward direction of said headlamp.

3. The automotive headlamp of claim 2, wherein said forward metal support is substantially L-shaped and does not project forward of said forward end of said longer lead support.

4. The automotive headlamp of claim 3, further comprising a direct-ray shade provided on said forward metal support.

5. The automotive headlamp of claim 4, wherein said forward metal support comprises a lamp holding portion in the form of a rectangular frame for holding a pinch seal portion at a forward end side of said discharge lamp, a lead-wire fixing portion welded to a forward lead wire of said discharge lamp, and a leg portion welded to a front end portion of said longer lead support.

6. The automotive headlamp of claim 5, wherein said lead-wire fixing portion comprises a pair of opposed portions extending forward from said lamp holding portion, said opposed portions having horizontal concave stripe portions formed therein engageable with said forward lead wire.

7. The automotive headlamp of claim 5, wherein said leg portion comprises a pair of downward extending portions extending downward from said lamp holding portion, said downward extending portions having horizontal concave stripe portions formed therein engaged with said front end of said longer lead support.

8. The automotive headlamp of claim 5, wherein said direct shade portion is welded to said lamp holding portion.

9. The automotive headlamp of claim 2, further comprising an ultraviolet-ray shielding filter disposed between said lamp and said lens.

10. The automotive headlamp of claim 2, wherein said globe completely covers said discharge bulb.

11. The automotive headlamp of claim 2, wherein an opening is formed in a forward end of said globe, a forward end of said forward metal support projecting through said opening.

12. An automotive headlamp comprising:

a lamp body;

a reflector mounted in said lamp body;

a discharge bulb mounted in a bulb insertion hole in a rear portion of said reflector, said discharge bulb comprising an insulating lamp base, a lead support projecting forward from said lamp base, a discharge lamp, a cylindrical ultraviolet-ray shielding globe disposed around said discharge lamp, forward and rear end ceramic discs disposed at front and rear opening end portions of said cylindrical ultraviolet-ray shielding globe for mounting said discharge lamp within said cylindrical ultraviolet-ray shielding globe to form a discharge lamp and globe assembly, said rear and front end portions of said discharge lamp and globe assembly being fixedly supported on said insulating lamp base and said lead support, a front end portion of said ultraviolet-ray shielding globe being dimensioned and shaped so as not to interfere with light reflected from a circumferential edge portion of said reflector around said bulb insertion hole; and a lens provided in front of said reflector so as to distribute light reflected by said reflector in a forward direction of said headlamp.

13. The automotive headlamp of claim 12, wherein an area of said globe corresponding to a discharge portion of said discharge lamp is expanded into an ellipsoidal shape having a diameter larger than a diameter of end opening portions of said globe.

14. The automotive headlamp of claim 12, further comprising at least one rivet embedded in said insulating base and passing through a through hole in said rear ceramic disc for fixing said rear ceramic disc to said insulating base.

15. The automotive headlamp of claim 12, further comprising a bonding agent for fixing and sealing said ceramic discs to respective end portions of said discharge lamp and said globe.

16. The automotive headlamp of claim 15, wherein a vacuum condition is provided in a space between said discharge lamp and said globe.

17. The automotive headlamp of claim 12, wherein said forward and rear ceramic discs are of the same diameter, and further comprising a cylindrical projection extending from a forward side of said lamp base, a rear end portion of said discharge lamp and globe assembly being received in and supported by said cylindrical projection.

* * * * *